US012669262B2

(12) United States Patent
Zhang et al.

(10) Patent No.: US 12,669,262 B2
(45) Date of Patent: Jun. 30, 2026

(54) WATER LEVEL CONTROL METHOD OF AIR CONDITIONER AND AIR CONDITIONER

(71) Applicant: HISENSE (GUANGDONG) AIR CONDITIONING CO., LTD., Jiangmen City (CN)

(72) Inventors: Shuming Zhang, Jiangmen City (CN); Xinmin Wang, Jiangmen City (CN); Baisheng Yu, Jiangmen City (CN)

(73) Assignee: HISENSE (GUANGDONG) AIR CONDITIONING CO., LTD., Jiangmen (CN)

( * ) Notice: Subject to any disclaimer, the term of this patent is extended or adjusted under 35 U.S.C. 154(b) by 375 days.

(21) Appl. No.: 18/348,939

(22) Filed: Jul. 7, 2023

(65) Prior Publication Data

US 2023/0349590 A1 Nov. 2, 2023

Related U.S. Application Data

(63) Continuation of application No. PCT/CN2021/143311, filed on Dec. 30, 2021.

(30) Foreign Application Priority Data

Jul. 26, 2021 (CN) ..... 202110842655.3

(51) Int. Cl.
*F24F 13/22* (2006.01)
*F24F 3/14* (2006.01)
(Continued)

(52) U.S. Cl.
CPC ..... *F24F 13/222* (2013.01); *F24F 3/1405* (2013.01); *F24F 2003/1446* (2013.01);
(Continued)

(58) Field of Classification Search
CPC .. F24F 5/0035; F24F 13/222; F24F 2013/225; F24F 3/1405; F24F 2003/1446; F24F 2140/30; F24F 2140/20
See application file for complete search history.

(56) References Cited

U.S. PATENT DOCUMENTS

2016/0123651 A1* 5/2016 Barbely ..... F24F 13/20 62/291
2023/0349590 A1 11/2023 Zhang et al.

FOREIGN PATENT DOCUMENTS

CN 107560074 A 1/2018
CN 108344064 A 7/2018
(Continued)

OTHER PUBLICATIONS

International Search Report and Written Opinion in corresponding International Application No. PCT/CN2021/143311, dated Apr. 20, 2022, translated, 17 pages.
(Continued)

*Primary Examiner* — Tavia Sullens
(74) *Attorney, Agent, or Firm* — MH2 Technology Law Group LLP

(57) ABSTRACT

A water level control method of an air conditioner and the air conditioner are provided. The air conditioner includes a first fan, a condenser, a compressor, a water tank, a rotating wheel, and a motor. The first fan is configured to dissipate heat from the condenser and the compressor. The motor is configured to drive the rotating wheel to rotate, so as to spray condensed water in the water tank onto the condenser. The method includes: if a water level of the condensed water reaches a first preset water level, controlling the first fan to operate at a minimum rotational speed and the motor to operate at a maximum rotational speed, and obtaining a condenser temperature, and controlling at least one of a rotational speed of the first fan, a rotational speed of the
(Continued)

motor, or an operating frequency of the compressor according to the condenser temperature.

19 Claims, 8 Drawing Sheets

(51) Int. Cl.
*F24F 140/20* (2018.01)
*F24F 140/30* (2018.01)

(52) U.S. Cl.
CPC ..... *F24F 2013/225* (2013.01); *F24F 2140/20* (2018.01); *F24F 2140/30* (2018.01)

(56) References Cited

FOREIGN PATENT DOCUMENTS

| | | | |
|---|---|---|---|
| CN | 208205243 | U | 12/2018 |
| CN | 109109612 | A | 1/2019 |
| CN | 111457544 | A | 7/2020 |
| CN | 111536651 | A | 8/2020 |
| CN | 111720969 | A | 9/2020 |
| CN | 111720970 | A | 9/2020 |
| CN | 111928432 | A | 11/2020 |
| CN | 112032962 | A | 12/2020 |
| CN | 112032963 | A | 12/2020 |
| CN | 112944646 | A | 6/2021 |
| CN | 113587347 | A | 11/2021 |
| JP | 2006234249 | A | 9/2006 |
| KR | 20000073047 | A | 12/2000 |
| KR | 1020190106560 | A | 9/2019 |

OTHER PUBLICATIONS

Chinese Notification of Grant of Invention Patent Rights in corresponding Chinese Application No. 202110842655.3, dated May 7, 2022, translated, 6 pages.

Chinese First Office Action dated Jul. 31, 2025 in corresponding Chinese Application No. 202180085950.7, translated, 28 pages.

* cited by examiner

WATER LEVEL CONTROL METHOD OF AIR CONDITIONER AND AIR CONDITIONER

CROSS-REFERENCE TO RELATED APPLICATIONS

This application is a continuation application of International Patent Application No. PCT/CN2021/143311, filed on Dec. 30, 2021, which claims priority to Chinese Patent Application No. 202110842655.3, filed on Jul. 26, 2021, which are incorporated herein by reference in their entireties.

TECHNICAL FIELD

The present disclosure relates to the field of air conditioning technologies, and in particular, to a water level control method of an air conditioner and an air conditioner.

BACKGROUND

The air conditioner performs a cooling cycle of the air conditioner by using a compressor, a condenser, an expansion valve, and an evaporator. The air conditioner will generate a large amount of condensed water after operating in a cooling mode or a dehumidification mode for a long time.

SUMMARY

In an aspect, a water level control method of an air conditioner is provided. The air conditioner includes a first fan, a condenser, a compressor, a water tank, a rotating wheel, and a motor. The first fan is configured to dissipate heat from the condenser and the compressor, and the motor is configured to drive the rotating wheel to rotate, so as to spray condensed water in the water tank onto the condenser. The water level control method of the air conditioner includes: if a water level of the condensed water reaches a first preset water level, controlling the first fan to operate at a minimum rotational speed and the motor to operate at a maximum rotational speed, and obtaining a condenser temperature, and controlling at least one of a rotational speed of the first fan, a rotational speed of the motor, or an operating frequency of the compressor according to the condenser temperature.

In another aspect, an air conditioner is provided. The air conditioner includes a condenser, a compressor, a first fan, a water tank, a rotating wheel, a motor, and a controller. The first fan is configured to dissipate heat from the condenser and the compressor. The water tank is configured to accommodate condensed water generated during operation of the air conditioner. The motor is connected to the rotating wheel and is configured to drive the rotating wheel to rotate; so as to spray the condensed water in the water tank onto the condenser. The controller is configured to: if a water level of the condensed water reaches a first preset water level, control the first fan to operate at a minimum rotational speed and the motor to operate at a maximum rotational speed, and obtain a condenser temperature, and control at least one of a rotational speed of the first fan, a rotational speed of the motor, or an operating frequency of the compressor according to the condenser temperature; if the water level of the condensed water reaches a second preset water level, obtain the condenser temperature and an ambient temperature, and control the compressor according to the condenser temperature and the ambient temperature. The second preset water level is higher than the first preset water level.

In yet another aspect, an air conditioner is provided. The air conditioner includes a memory and a processor. The memory stores one or more computer programs, the one or more computer programs include instructions. When the instructions are executed by the processor, the air conditioner is caused to execute the water level control method of the air conditioner.

DETAILED DESCRIPTION

Figure 1:
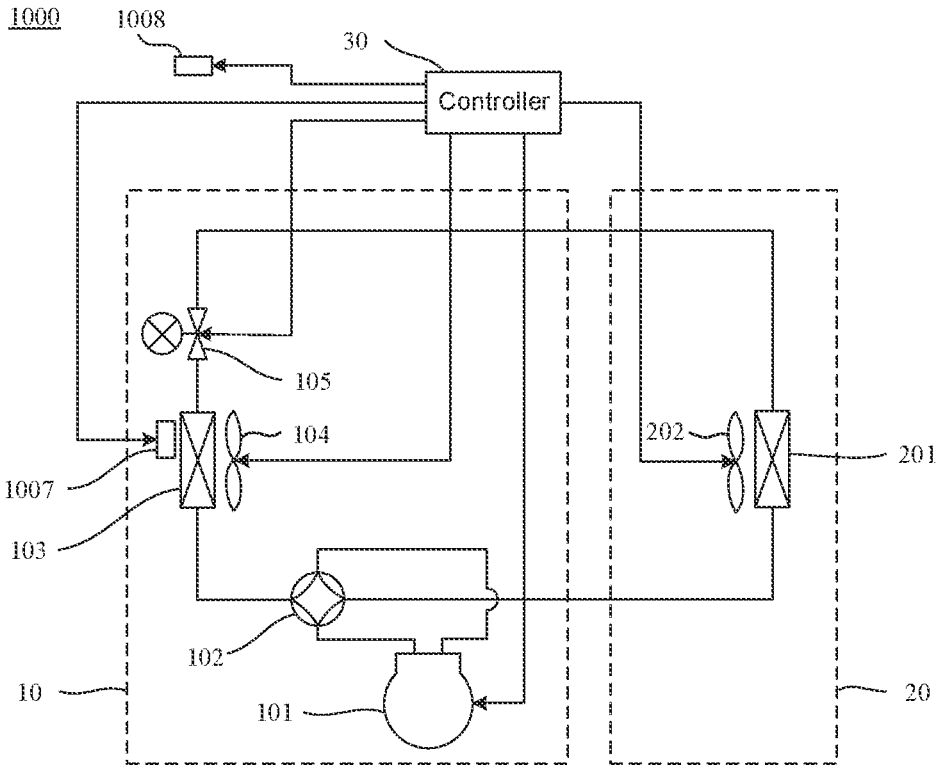
FIG. 1 is a schematic diagram of an air conditioner; in accordance with some embodiments.

Some embodiments of the present disclosure will be clearly and completely described below with reference to the accompanying drawings. However, the described embodiments are merely some but not all embodiments of the present disclosure. All other embodiments obtained by a person of ordinary skill in the art based on embodiments of the present disclosure shall be included in the protection scope of the present disclosure.

Unless the context requires otherwise, throughout the specification and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment," "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition; the specific features, structures, materials, or characteristics may be included in any one or more embodiments or examples in any suitable manner.

Hereinafter, the terms such as "first" and "second" are used for descriptive purposes only and are not to be construed as indicating or implying the relative importance or implicitly indicating the number of indicated technical features. Thus, features defined by "first" or "second" may explicitly or implicitly include one or more of the features. In the description of the embodiments of the present disclosure, the term "a plurality of" or "the plurality of" means two or more unless otherwise specified.

In the description of some embodiments, the expressions "coupled," "connected," and derivatives thereof may be used. The term "connected" should be understood in a broad sense. For example, the term "connected" may represent a fixed connection, a detachable connection, or a one-piece connection, or may represent a direct connection, or may represent an indirect connection through an intermediate medium. The term "coupled" indicates that two or more components are in direct physical or electrical contact with each other. The term "coupled" or "communicatively coupled" may also mean that two or more components are not in direct contact with each other but still cooperate or interact with each other. The embodiments disclosed herein are not necessarily limited to the content herein.

The phrase "at least one of A, B, and C" has the same meaning as the phrase "at least one of A, B, or C", both including the following combinations of A, B, and C: only A, only B, only C, a combination of A and B, a combination of A and C, a combination of B and C, and a combination of A, B, and C.

As used herein, the term "if" is, optionally, construed as "when" or "in a case where" or "in response to determining that" or "in response to detecting," depending on the context. Similarly, depending on the context, the phrase "if it is determined that" or "if [a stated condition or event] is detected" is optionally construed as "in a case where it is determined that" or "in response to determining that" or "in a case where [the stated condition or event] is detected" or "in response to detecting [the stated condition or event]."

The use of the phrase "applicable to" or "configured to" herein means an open and inclusive expression, which does not exclude devices that are applicable to or configured to perform additional tasks or steps.

The term such as "about," "substantially," and "approximately" as used herein includes a stated value and an average value within an acceptable range of deviation of a particular value. The acceptable range of deviation is determined by a person of ordinary skill in the art, considering measurement in question and errors associated with measurement of a particular quantity (i.e., limitations of a measurement system), The term such as "parallel," "perpendicular," or "equal" as used herein includes a stated condition and a condition similar to the stated condition. A range of the similar condition is within an acceptable deviation range, and the acceptable deviation range is determined by a person of ordinary skill in the art, considering measurement in question and errors associated with measurement of a particular quantity (i.e., the limitations of a measurement system). For example, the term "parallel" includes absolute parallelism and approximate parallelism, and an acceptable deviation range of the approximate parallelism may be, for example, a deviation within 5°. The term "perpendicular" includes absolute perpendicularity and approximate perpendicularity, and an acceptable deviation range of the approximate perpendicularity may also be, for example, a deviation within 5°. The term "equal" includes absolute equality and approximate equality, and an acceptable deviation range of the approximate equality may be that, for example, a difference between the two that are equal is less than or equal to 5% of either of the two.

Any value within a range as used herein may be two endpoints, or any value within the range. For example, a preset duration is any value within a range of A min to B min, and the preset duration may be A min, C min, or B min (A<C<B).

Some embodiments of the present disclosure provide an air conditioner 1000. As shown in FIG. 1, the air conditioner 1000 includes an outdoor unit 10 and an indoor unit 20. The outdoor unit 10 is connected with the indoor unit 20 by means of a pipe, so as to transport refrigerant.

The outdoor unit 10 includes a compressor 101, a four-way valve 102, an outdoor heat exchanger 103, a first fan 104, and an expansion valve 105. The indoor unit 20 includes an indoor heat exchanger 201 and a second fan 202. The compressor 101, the outdoor heat exchanger 103, the expansion valve 105 and the indoor heat exchanger 201 are connected in sequence, so as to form a refrigerant cycle. The refrigerant circulates in the refrigerant cycle and exchanges heat with the surrounding air through the outdoor heat exchanger 103 and the indoor heat exchanger 201, so as to achieve a cooling mode or a heating mode of the air conditioner 1000.

The compressor 101 is configured to compress the refrigerant, so as to make a refrigerant with a low pressure be compressed to be a refrigerant with a high pressure.

The outdoor heat exchanger 103 is configured to exchange heat between outdoor air and the refrigerant transported in the outdoor heat exchanger 103. For example, the outdoor heat exchanger 103 operates as a condenser in the cooling mode of the air conditioner 1000, and the outdoor heat exchanger 103 operates as an evaporator in the heating mode of the air conditioner 1000.

In some embodiments, the outdoor heat exchanger 103 may include heat exchange fins, so as to expand a contact area between the outdoor air and the refrigerant transported in the outdoor heat exchanger 103, thereby improving heat exchange efficiency between the outdoor air and the refrigerant.

The first fan 104 is configured to draw the outdoor air into the outdoor unit 10 through an outdoor air inlet of the outdoor unit 10 and exhaust the outdoor air after the outdoor air exchanges heat with the outdoor heat exchanger 103 through an outdoor air outlet of the outdoor unit 10.

The expansion valve 105 is connected with the outdoor heat exchanger 103 and the indoor heat exchanger 201. A pressure of the refrigerant flowing through the outdoor heat exchanger 103 and the indoor heat exchanger 201 is regulated by an opening degree of the expansion valve 105, so as to regulate a flow rate of the refrigerant flowing between the outdoor heat exchanger 103 and the indoor heat exchanger 201

The four-way valve 102 is disposed in the refrigerant cycle and is configured to switch a flow direction of the refrigerant in the refrigerant cycle, so that the air conditioner 1000 may operate in the cooling mode or the heating mode, The indoor heat exchanger 201 is configured to perform heat-exchange between indoor air and the refrigerant transported in the indoor heat exchanger 201. For example, the indoor heat exchanger 201 operates as an evaporator in the cooling mode of the air conditioner 1000, and the indoor heat exchanger 201 operates as a condenser in the heating mode of the air conditioner 1000.

In some embodiments, the indoor heat exchanger 201 may further include heat exchange fins, so as to expand a contact area between the indoor air and the refrigerant transported in the indoor heat exchanger 201, thereby improving heat exchange efficiency between the indoor air and the refrigerant.

The second fan 202 is configured to draw the indoor air into the indoor unit 20 through an indoor air inlet of the indoor unit 20 and exhaust the indoor air after the indoor air exchanges heat with the indoor heat exchanger 201 through an indoor air outlet of the indoor unit 20.

In some embodiments, as shown in FIG. 1, the air conditioner 1000 further includes a controller 30. The controller 30 is configured to control an operating frequency of the compressor 101, an opening degree of the expansion valve 105, a rotational speed of the first fan 104, and a rotational speed of the second fan 202. The controller 30 is coupled with the compressor 101, the expansion valve 105, the first fan 104, and the second fan 202 through data lines, so as to transmit communication information.

The controller 30 includes a processor. The processor may include a central processing unit (CPU), a microprocessor, or an application specific integrated circuit (ASIC), and the processor may be configured to execute the corresponding operations described in the controller 30 when the processor executes a program stored in a non-transitory computer-readable media coupled to the controller 30.

The cooling mode, the dehumidification mode, and the heating mode of the air conditioner 1000 will be described in detail below.

In a case where the air conditioner 1000 operates in the cooling mode, the refrigerant flows through the compressor 101, the four-way valve 102, the outdoor heat exchanger 103, the expansion valve 105, the indoor heat exchanger 201 and the compressor 101 in sequence. The outdoor heat exchanger 103 operates as the condenser and the indoor heat exchanger 201 operates as the evaporator. A temperature of the condenser is high and a temperature of the evaporator is low. The condenser dissipates the heat of the refrigerant in the condenser to the outdoor air, and the refrigerant in the evaporator absorbs the heat of the indoor air to reduce an indoor ambient temperature, so as to cool the indoor environment. In this case, where the temperature of the evaporator (e.g., the indoor heat exchanger 201) is less than the indoor ambient temperature, water vapor in the indoor air condenses into liquid water (i.e., the condensed water) on a surface of the evaporator. Especially in summer, the air has high humidity and contains a large amount of water vapor, which makes it easy for the condensed water to form on the surface of the evaporator. The dehumidification mode of the air conditioner 1000 operates by using the principle that the water vapor in the air will condense into the liquid water when cooled.

In a case where the air conditioner 1000 operates in the dehumidification mode, the indoor air is guided to the evaporator by the second fan 202, so that the water vapor in the indoor air condenses into the liquid water on the surface of the evaporator. As a result, the water vapor in the indoor air may be separated from the indoor air, so as to achieve the dehumidification effect on the indoor air. Therefore, the air conditioner 1000 will generate a large amount of condensed water after operating in the cooling mode or the dehumidification mode for a long time.

In a case where the air conditioner 1000 operates in the heating mode, the refrigerant flows through the compressor 101, the four-way valve 102, the indoor heat exchanger 201, the expansion valve 105, the outdoor heat exchanger 103, and the compressor 101 in sequence. The outdoor heat exchanger 103 operates as the evaporator and the indoor heat exchanger 201 operates as the condenser. The temperature of the condenser is high, and the temperature of the evaporator is low. The condenser dissipates the heat of the refrigerant in the condenser to the indoor air to increase the indoor ambient temperature, so as to achieve the heating for the indoor environment. The refrigerant in the evaporator absorbs the heat of the outdoor air. In this case, where the temperature of the evaporator (e.g., the outdoor heat exchanger 103) is less than the outdoor ambient temperature, the water vapor in the outdoor air condenses into the liquid water on the surface of the evaporator. However, generally, the air in winter has low humidity and contains a small amount of water vapor, so that in the case where the air conditioner 1000 operates in the heating mode, the condensed water is not easy to form on the surface of the evaporator.

The above description is mainly given by considering an example in which the air conditioner 1000 is a split-type air conditioner, however, the present disclosure is not limited thereto. In some embodiments, the air conditioner 1000 may also be an integral-type air conditioner (e.g., a portable air conditioner).

Figure 2:
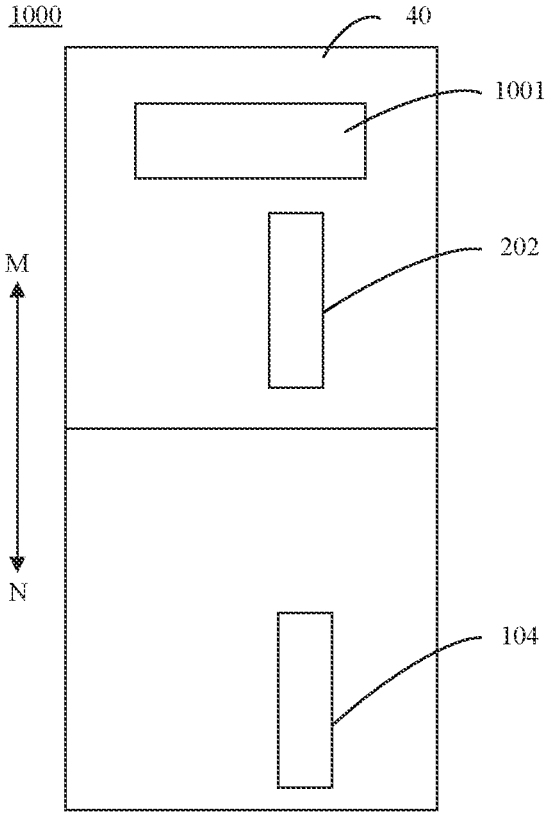
FIG. 2 is a schematic diagram of another air conditioner, in accordance with some embodiments.

As shown in FIG. 2, the air conditioner 1000 includes an air conditioner body 40, a first fan 104, a second fan 202, and a display device 1001. In the case where the air conditioner 1000 operates in one of the cooling mode and the dehumidification mode, the first fan 104 may be disposed in a lower portion (e.g., the N side) of the air conditioner body 40 and is configured to dissipate heat from the condenser and the compressor 101, so as to reduce the temperatures of the condenser and the compressor 101. The second fan 202 may be disposed in an upper portion (e.g., the M side) of the air conditioner body 40 and is configured to drive the circulation and exchange between the air inside the air conditioner 1000 and the air outside the air conditioner 1000. The display device 1001 may be disposed on the upper portion of the air conditioner body 40, and the display device 1001 is configured to display information such as a current operating mode and temperature (e.g., the indoor ambient temperature, the outdoor ambient temperature, the condenser temperature, or the evaporator temperature) of the air conditioner 1000. For example, the display device 1001 may be a display screen, or a wire controller.

It will be noted that, in the case where the air conditioner 1000 is the integral-type air conditioner, the outdoor heat exchanger 103 is disposed in the air conditioner body 40. For example, the outdoor heat exchanger 103 is disposed in the air conditioner body 40 and communicates with the outdoor environment through pipes, so as to exchange heat with the outdoor air. In addition, some embodiments of the present disclosure are described by considering an example in which the first fan 104 is disposed in the lower portion of the air conditioner body 40 and the second fan 202 is disposed in the upper portion of the air conditioner body 40. Of course, the first fan 104 and the second fan 202 may also be disposed at other positions of the air conditioner body 40, and the present disclosure is not limited thereto.

During the operation of the air conditioner in one of the cooling mode and the dehumidification mode, a large amount of condensed water will be generated, and the condensed water will flow into a water tank. A motor drives a rotating wheel to spray the condensed water in the water tank onto the condenser, so as to evaporate the condensed water while cooling the condenser, thereby reducing a water level of the condensed water in the water tank. However, in a case where an evaporation rate of the condensed water is slow, the condensed water in the water tank is easy to overflow. Some related arts provide a method of adjusting the evaporation rate of the condensed water on the condenser according to the water level of the condensed water. However, the method cannot accurately control the operating status of components in the air conditioner, which easily affects the heating effect or the cooling effect of the air conditioner, and easily causes damage to the condenser due to excessive high temperature of the condenser.

In order to solve the above problem, the air conditioner 1000 in some embodiments of the present disclosure controls the water level of the condensed water by adjusting at least one of the rotational speed of the first fan 104, a rotational speed of a motor 1004, or the operating frequency of the compressor 101, so as to prevent the excessive condensed water from accumulating in the air conditioner 1000 while also avoiding affecting the cooling effect or the heating effect of the air conditioner 1000.

Figure 3:
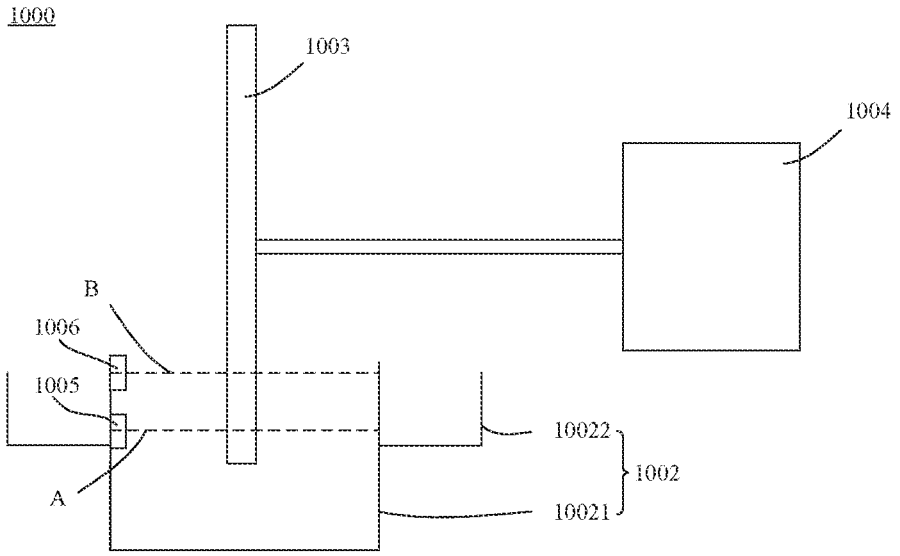
FIG. 3 is a schematic diagram of a water tank, a motor, and a rotating wheel in an air conditioner, in accordance with some embodiments.

In some embodiments, as shown in FIG. 3, the air conditioner 1000 further includes a water tank 1002, a rotating wheel 1003, and a motor 1004.

The water tank 1002 is configured to accommodate the condensed water generated during the operation of the air conditioner 1000. Since the indoor heat exchanger 201 and the outdoor heat exchanger 103 each may operate as the evaporator, the condensed water generated by the indoor heat exchanger 201 and the outdoor heat exchanger 103 may flow into the water tank 1002. In the case where the air conditioner 1000 operates in one of the cooling mode and the dehumidification mode, the condensed water in the water tank 1002 needs to be sprayed onto the condenser, so as to use the heat dissipated by the condenser for evaporation, and the outdoor heat exchanger 103 is the condenser, Therefore, the water tank 1002 may be arranged near the outdoor heat exchanger 103, so as to be proximate to the outdoor heat exchanger 103, so that the condensed water may be sprayed onto the condenser for evaporation.

The motor 1004 is connected to the rotating wheel 1003, and the motor 1004 is configured to drive the rotating wheel 1003 to rotate, so as to spray the condensed water in the water tank 1002 onto the condenser, so that the condensed water sprayed onto the condenser is evaporated by absorbing the heat generated by the condenser, thereby reducing the water level of the condensed water in the water tank 1002 and reducing the condenser temperature. In the case where the air conditioner 1000 operates in one of the cooling mode and the dehumidification mode, the outdoor heat exchanger 103 is the condenser.

In some embodiments, as shown in FIGS. 1 and 3, the air conditioner 1000 further includes a first water level switch 1005, a second water level switch 1006, a first temperature sensor 1007, and a second temperature sensor 1008.

The first water level switch 1005 and the second water level switch 1006 each are configured to detect the water level of the condensed water in the water tank 1002. The first water level switch 1005 corresponds to a first preset water level A, and the second water level switch 1006 corresponds to a second preset water level B. The second preset water level B is higher than the first preset water level A. For example, the first preset water level A may be two-thirds of a maximum capacity of the water tank 1002, and the second preset water level B is the maximum capacity of the water tank 1002. In addition, the first water level switch 1005 and the second water level switch 1006 may adopt capacitive level switches or float level switches.

It will be noted that the above descriptions of the first preset water level A and the second preset water level B are examples. However, this will not be construed as a limitation of the present disclosure. The specific positions of the first preset water level A and the second preset water level B may be arranged according to actual conditions.

The first temperature sensor 1007 is configured to detect the condenser temperature, and the second temperature sensor 1008 is configured to detect an ambient temperature outside the air conditioner 1000. Here, in the case where the air conditioner 1000 is the integral-type air conditioner, the ambient temperature may refer to the indoor ambient temperature.

In some embodiments, referring to FIG. 3, the water tank 1002 includes a water tank body 10021 and a groove 10022 connected with the water tank body 10021, and the groove 10022 is configured to accommodate the condensed water overflowing from the water tank body 10021. For example, a capacity of the groove 10022 is approximately one-third of the maximum capacity of the water tank body 10021. For example, in a case where the water level of the condensed water reaches the second preset water level B (that is, in a case where the condensed water will overflow the water tank body 10021), if the condensed water cannot be evaporated by the condenser in a timely manner, the groove 10022 may accommodate the condensed water overflowing from the water tank body 10021, so as to avoid a situation of the condensed water overflowing from the water tank 1002 due to the inability of the condensed water to be evaporated by the condenser in a timely manner.

It will be noted that, in a case where the water tank 1002 includes the water tank body 10021 and the groove 10022, the maximum capacity of the water tank 1002 may refer to the maximum capacity of the water tank body 10021.

After the air conditioner 1000 operates in one of the cooling mode and the dehumidification mode for a period of time, in a case where an accumulating rate of the condensed water is greater than the evaporation rate of the condensed water evaporated by the condenser, even if the condensed water continues to be evaporated through the condenser, the water level of the condensed water will still continue to rise. Therefore, it is necessary to control the water level of the condensed water in the water tank 1002 in a timely manner.

In order to solve the above problem, some embodiments of the present disclosure provide a water level control method of an air conditioner, and the method is applied to the controller 30. For example, the logic (e.g., the software) of the water level control method of the air conditioner in some embodiments of the present disclosure may be written into the controller 30 of the air conditioner 1000. The water level control method may be applied to the integral-type air conditioner or the split-type air conditioner, and the structure of the integral-type air conditioner or the split-type air conditioner is similar to that of the air conditioner 1000, and details will not be repeated herein.

Figure 4:
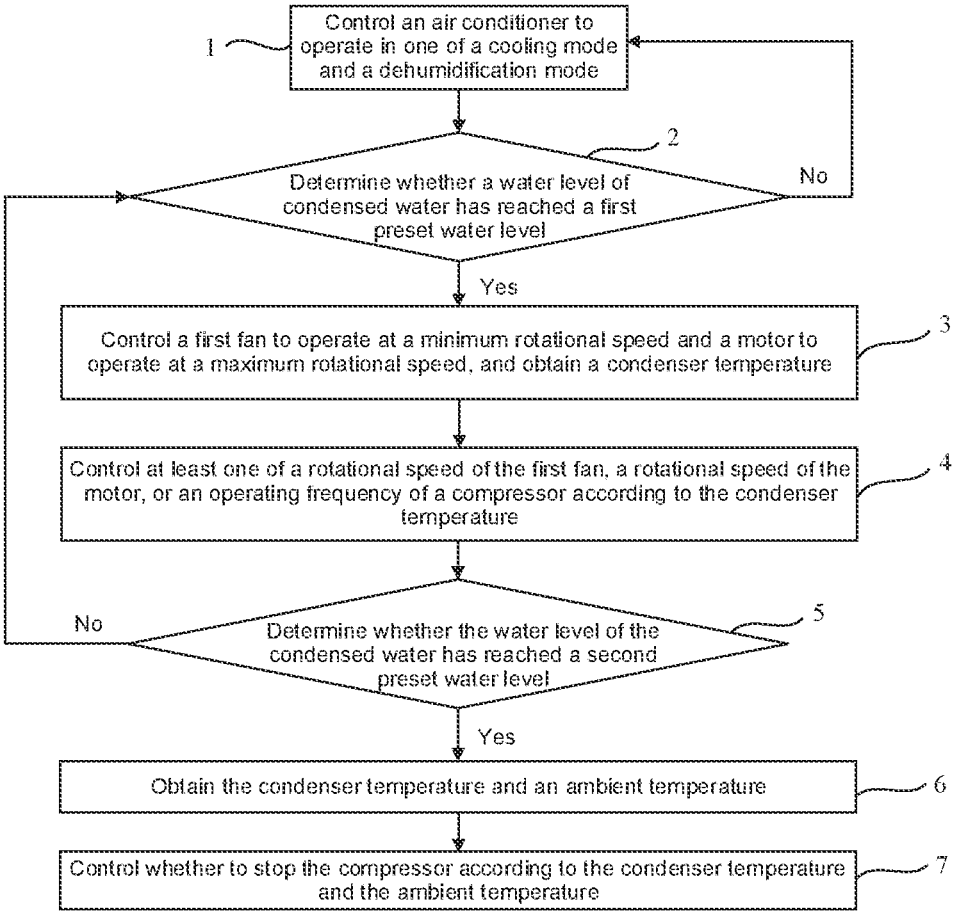
FIG. 4 is a flow chart of a water level control method of an air conditioner, in accordance with some embodiments.

In this case, as shown in FIG. 4, the water level control method of the air conditioner includes step 1 to step 7 (S1 to S7).

In step 1, the air conditioner 1000 is controlled to operate in one of a cooling mode and a dehumidification mode.

In step 2, whether a water level of condensed water has reached a first preset water level A is determined. If so, the step 3 is performed; if not, the step 1 is performed. For example, the air conditioner 1000 continues to operate in one of the cooling mode and the dehumidification mode.

The first water level switch 1005 may detect whether the water level of the condensed water in the water tank 1002 has reached the first preset water level A and send the detection result to the controller 30.

In step 3, the first fan 104 is controlled to operate at a minimum rotational speed and the motor 1004 is controlled to operate at a maximum rotational speed, and a condenser temperature T is obtained.

In step 4, at least one of a rotational speed of the first fan 104, a rotational speed of the motor 1004, or an operating frequency of the compressor 101 is controlled according to the condenser temperature T.

The rotational speed of the first fan 104 may be any value within a range of 650 r/min to 1000 r/min. In this case, the minimum rotational speed of the first fan 104 may be 650 r/min.

The controller 30 may obtain the condenser temperature T through the first temperature sensor 1007. Moreover, the controller 30 may control the rotational speed of the first fan 104, the rotational speed of the motor 1004, and the operating frequency of the compressor 101.

In step 5, whether the water level of the condensed water has reached a second preset water level B is determined. If so, the step 6 is performed; if not, the step 2 is performed.

The second water level switch 1006 may detect whether the water level of the condensed water in the water tank 1002 has reached the second preset water level B and send the detection result to the controller 30.

In step 6, the condenser temperature T and an ambient temperature $T_0$ are obtained.

In step 7, whether to stop the compressor 101 is controlled according to the condenser temperature T and the ambient temperature $T_0$.

The controller 30 may obtain the condenser temperature T through the first temperature sensor 1007 and obtain the ambient temperature $T_0$ through the second temperature sensor 1008.

In a case where the water level of the condensed water has reached the second preset water level B, the controller 30 controls whether to stop the compressor 101 according to the condenser temperature T and the ambient temperature $T_0$. For example, in a case where the condenser temperature T and the ambient temperature $T_0$ are high (e.g., the condenser temperature T is greater than 47° C. and the ambient temperature $T_0$ is greater than 34° C.), the load of the air conditioner 1000 is high, and the capacity of the condenser to evaporate the condensed water is insufficient, the water level of the condensed water in the water tank 1002 is difficult to be reduced due to the evaporation of the condenser. In this case, in order to avoid damage to the air conditioner 1000 caused by the excessively high water level of the condensed water (e.g., reaching or exceeding the second preset water level B) and the excessively high condenser temperature T, the controller 30 needs to control the compressor 101 to stop in a timely manner.

Figure 5:
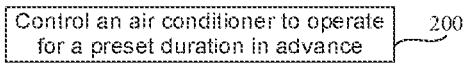
FIG. 5 is another flow chart of a water level control method of an air conditioner, in accordance with some embodiments.

In some embodiments, as shown in FIG. 5, before obtaining the condenser temperature T, the method further includes step 200 (S200).

In step 200, the air conditioner is controlled to operate for a preset duration in advance.

Before obtaining the condenser temperature T, the controller 30 may control the air conditioner 1000 to operate for the preset duration (e.g., 20 min to 30 min) in advance. After the air conditioner 1000 has operated for the preset duration, the air conditioner 1000 operates stably, and the condenser temperature T increases. In this case, the controller 30 obtains the condenser temperature T through the first temperature sensor 1007, so as to accurately control the operating frequency of the compressor 101 according to the condenser temperature T. Here, the air conditioner 1000 operates stably, which may refer to a case where the operating frequency of the compressor 101 is within a threshold range, and the operating frequency of the compressor 101 remains substantially unchanged.

The preset duration may be any value within a range of 20 min to 30 min.

Figure 6:
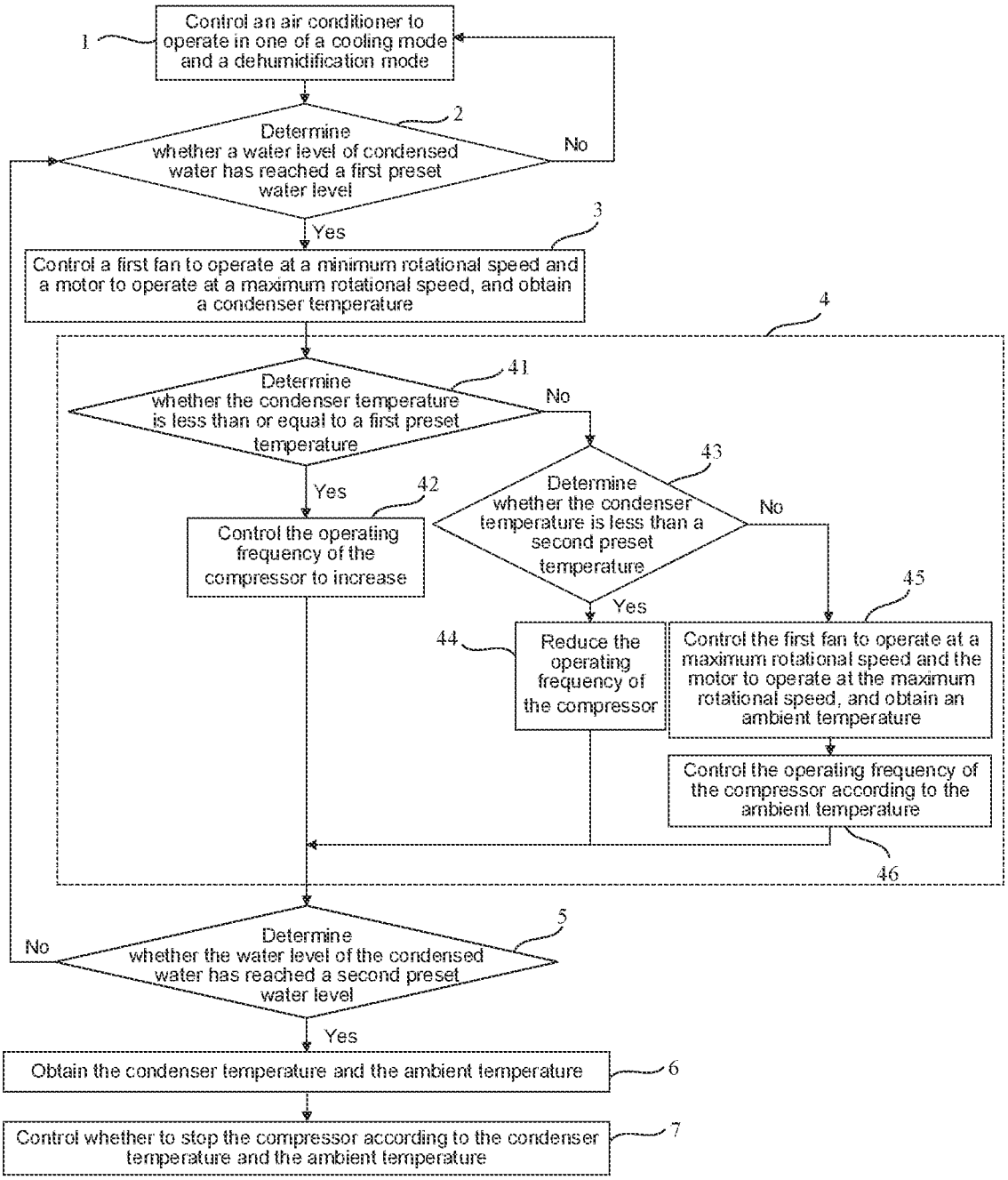
FIG. 6 is yet another flow chart of a water level control method of an air conditioner, in accordance with some embodiments.

In some embodiments, as shown in FIG. 6, the step 4 includes step 41 to step 46 (S41 to S46).

In step 41, whether the condenser temperature T is less than or equal to a first preset temperature $T_1$ is determined. If so, the step 42 is performed; if not, the step 43 is performed.

In step 42, an operating frequency of the compressor 101 is controlled to increase.

In step 43, whether the condenser temperature T is less than a second preset temperature $T_2$ is determined. If so; the step 44 is performed; if not, the step 45 is performed.

In step 44; the operating frequency of the compressor 101 is reduced.

In step 45, the first fan 104 is controlled to operate at the maximum rotational speed and the motor 1004 is controlled to operate at the maximum rotational speed, and the ambient temperature $T_0$ is obtained.

In step 46, the operating frequency of the compressor 101 is controlled according to the ambient temperature $T_0$.

The second temperature sensor 1008 may detect the ambient temperature $T_0$ and send the detection result to the controller 30.

In a case where the water level of the condensed water in the water tank 1002 has reached the first preset water level A, the controller 30 may reduce the heat dissipation effect of the first fan 104 on the condenser and improve the evaporation effect of the condenser on the condensed water by controlling the first fan 104 to operate at the minimum rotational speed. In this way, since the air conditioner 1000 is still operating, the condenser may continue to generate heat, which is conducive to improving the evaporation rate of the condensed water. Moreover, the controller 30 may speed up a speed at which the rotating wheel 1003 sprays the condensed water in the water tank 1002 onto the condenser by controlling the motor 1004 to operate at the maximum rotational speed, so that the condensed water in the water tank 1002 may be quickly evaporated by the condenser; thereby reducing the water level of the condensed water.

However, in a case where the first fan 104 operates at the minimum rotational speed and the motor 1004 operates at the maximum rotational speed, the water level of the condensed water in the water tank 1002 may still continue to rise.

In this case, in a case where the condenser temperature T is less than or equal to the first preset temperature $T_1$, the condenser temperature T is low; and the condenser temperature T may still continue to rise. In this way, by increasing the operating frequency of the compressor 101, it is possible to improve the heat exchange efficiency of the condenser, thereby improving the cooling effect of the air conditioner 1000 and the evaporation rate of the condensed water evaporated by the condenser.

In a case where the condenser temperature T is greater than the first preset temperature $T_1$ and less than the second preset temperature $T_2$, the condenser temperature T is high, and the controller 30 needs to reduce the operating frequency of the compressor 101, so as to prevent damage to the condenser due to excessive high condenser temperature T. Moreover, when the operating frequency of the compressor 101 is reduced, the generation rate of the condensed water is correspondingly reduced, so that the increasing rate of the water level of the condensed water in the water tank 1002 may also be reduced.

In a case where the condenser temperature T is greater than or equal to the second preset temperature $T_2$, the condenser temperature T is too high (e.g., proximate to the maximum temperature that the condenser may withstand), and the condenser is easy to be damaged. Therefore, the controller 30 needs to increase the rotational speed of the first fan 104, so as to improve the heat dissipation effect of the first fan 104 on the condenser, thereby reducing the condenser temperature T. Here, the maximum temperature that the condenser can withstand may be 47° C.

In addition, the controller 30 may also determine whether the load of the air conditioner 1000 is high according to the ambient temperature $T_0$, so as to adjust (e.g., reduce) the operating frequency of the compressor 101.

Figure 7:
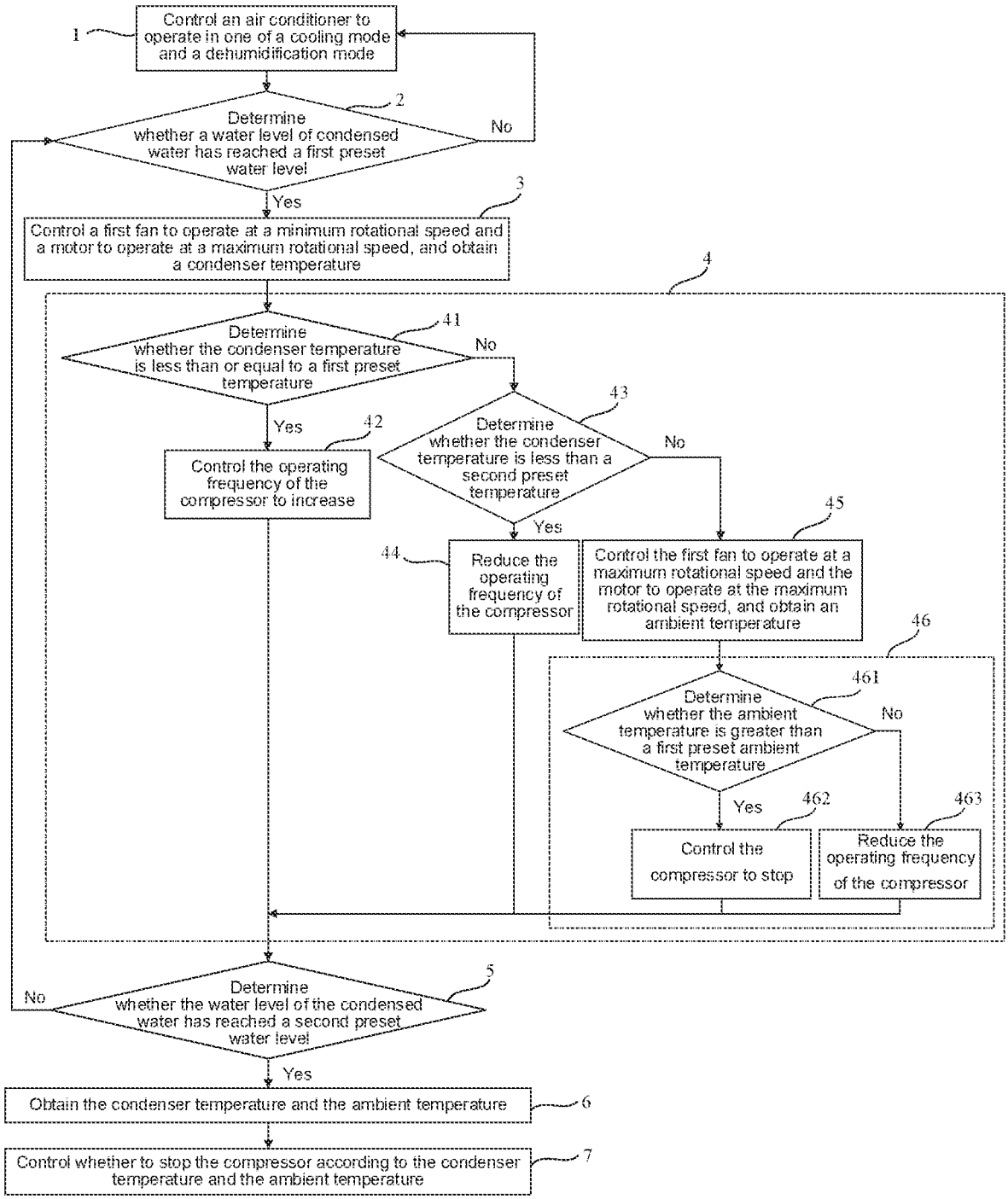
FIG. 7 is yet another flow chart of a water level control method of an air conditioner, in accordance with some embodiments.

In some embodiments, as shown in FIG. 7, the step 46 includes step 461 to step 463 (S461 to S463).

In step 461, whether the ambient temperature $T_0$ is greater than a first preset ambient temperature $T_{01}$ is determined. If so, the step 462 is performed; if not, the step 463 is performed.

In step 462, the compressor 101 is controlled to stop.

In step 463, the operating frequency of the compressor 101 is reduced.

In a case where the ambient temperature $T_0$ is greater than the first preset ambient temperature $T_{01}$, the condenser temperature T and the ambient temperature $T_0$ are high, and the load of the compressor 101 is high, and the heat generated by the condenser is difficult to make the condensed water be evaporated in a timely manner. Therefore, the controller 30 needs to control the compressor 101 to stop, so as to prevent further increase in condenser temperature T, which may cause damage to the condenser. Moreover, the controller 30 controls the compressor 101 to stop, which may also avoid a problem that the condensed water overflows due to the continuous increase of the water level of the condensed water in the water tank 1002.

In a case where the ambient temperature $T_0$ is less than or equal to the first preset ambient temperature $T_{01}$, although the condenser temperature T is high (e.g., the condenser temperature T is greater than 45° C.), the ambient temperature $T_0$ is low. In this case, the controller 30 reduces the operating frequency of the compressor 101, which may prevent the condenser temperature T from being too high (e.g., the condenser temperature T is greater than 47° C.), so that the air conditioner 1000 may still continue to operate.

In some embodiments, the first preset temperature $T_1$ is any value within a range of 36° C. to 40° C. The second preset temperature $T_2$ is any value within a range of 43° C. to 47° C., The first preset ambient temperature $T_{01}$ is any value within a range of 30° C. to 34° C.

Here, the first preset temperature $T_1$, the second preset temperature $T_2$, and the first preset ambient temperature $T_{01}$ may be set according to the model of the air conditioner.

The condenser temperature T and the ambient temperature $T_0$ each correspond to different preset values. That is to say, the condenser temperature T corresponds to the first preset temperature $T_1$ and the second preset temperature $T_2$, and the ambient temperature $T_0$ corresponds to the first preset ambient temperature $T_{01}$. In this way, the controller 30 may accurately adjust the operating states of the corresponding components in the air conditioner 1000 and improve the operating efficiency of the air conditioner 1000 and the evaporation efficiency of the condenser on the condensed water.

Figure 8:
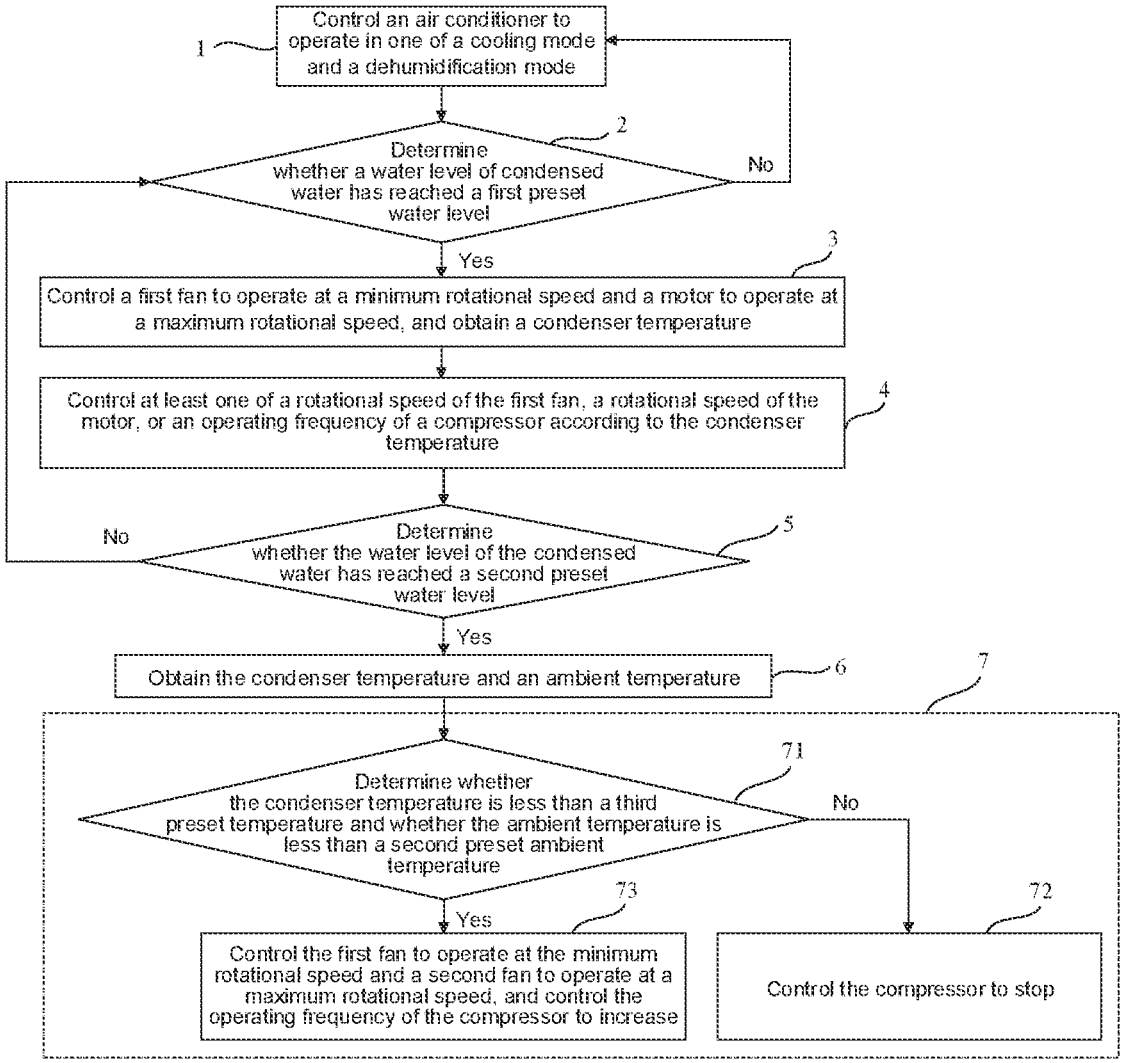
FIG. 8 is yet another flow chart of a water level control method of an air conditioner, in accordance with some embodiments.

In some embodiments, as shown in FIG. 8, the step 7 includes step 71 to step 73 (S71 to S73).

In step 71, whether the condenser temperature T is less than a third preset temperature $T_3$ is determined and whether the ambient temperature $T_0$ is less than a second preset ambient temperature $T_{02}$ is determined. If so, the step 73 is performed; if not, the step 72 is performed.

In step 72, the compressor 101 is controlled to stop.

In a case where the water level of the condensed water has reached the second preset water level B, the controller 30 needs to reduce the water level of the condensed water in a timely manner. The controller 30 may determine whether to control the compressor 101 to stop according to the condenser temperature T and the ambient temperature $T_0$.

For example, in a case where one of the condenser temperature T being greater than or equal to a third preset temperature $T_3$, and the ambient temperature $T_0$ being greater than or equal to the second preset ambient temperature $T_{02}$ is satisfied, the load of the air conditioner 1000 is high; and the controller 30 needs to control the compressor 101 to stop in a timely manner, so as to avoid the generation of the condensed water due to the continued operation of compressor 101, thereby preventing the condensed water from overflowing. Moreover, the controller 30 controls the compressor 101 to stop, which may also prevent the condenser temperature T from continuing to rise and avoid damage to the condenser and the air conditioner 1000.

In step 73, the first fan 104 is controlled to operate at the minimum rotational speed and the second fan 202 is controlled to operate at the maximum rotational speed, and the operating frequency of the compressor 101 is controlled to increase.

For example, in a case where the condenser temperature T is less than the third preset temperature $T_3$; and the ambient temperature $T_0$ is less than the second preset ambient temperature $T_{02}$, the condenser temperature T may still continue to rise, and the compressor 101 may continue to operate. In this case, the controller 30 increases the operating frequency of the compressor 101, which may accelerate the evaporation rate of the condensed water, thereby reducing the water level of the condensed water. Moreover, by controlling the second fan 202 to operate at the maximum rotational speed; it is possible to increase a speed at which the water vapor formed by the evaporation of condensed water is discharged to the outdoors and reduce the water vapor content in the air conditioner 1000; which is easy for the condensed water to be evaporated by the condenser.

The rotational speed of the second fan 202 may be any value within a range of 750 r/min to 1200 r/min. In this case, the maximum rotational speed of the second fan 202 is 1200 r/min.

Figure 9:
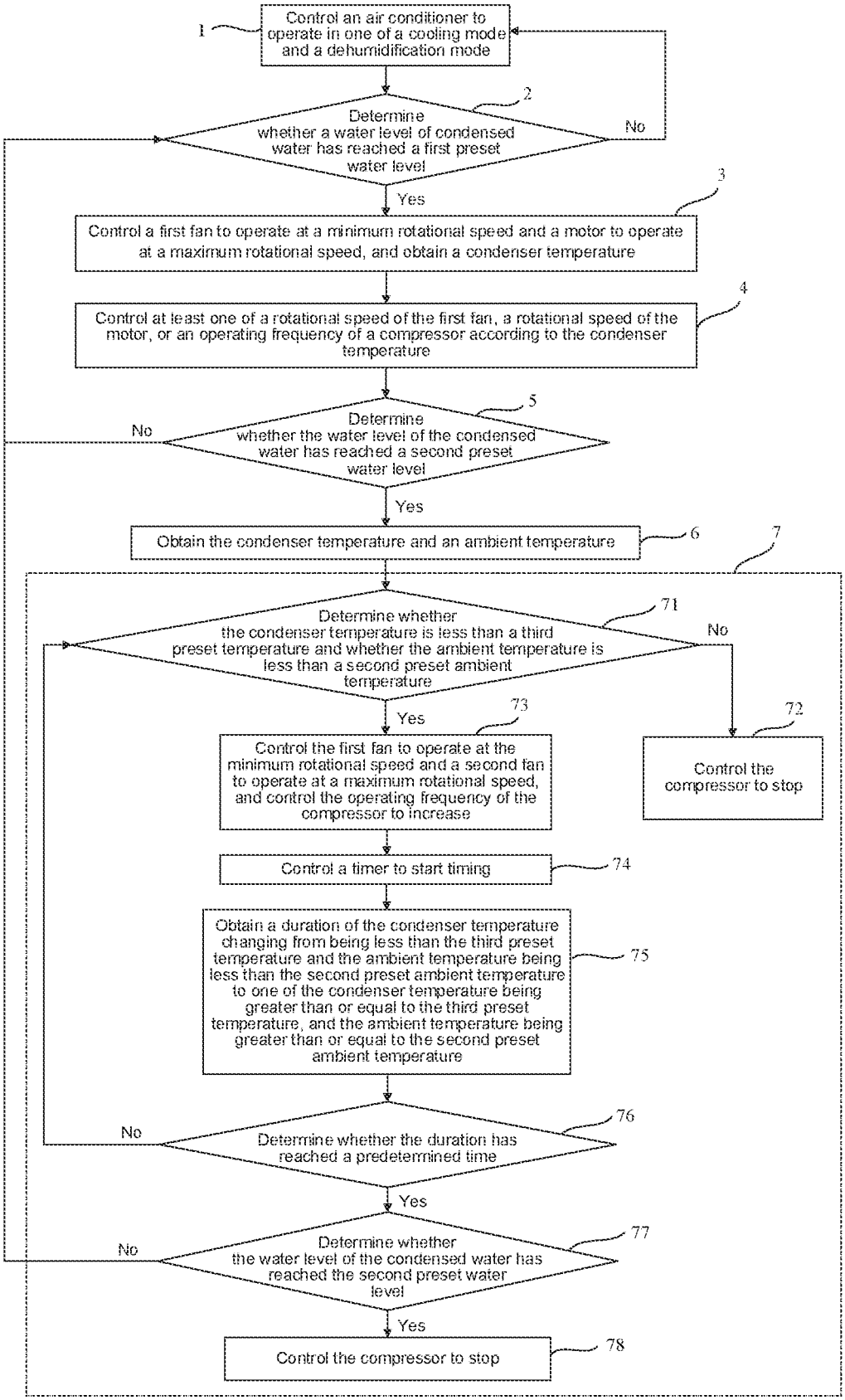
FIG. 9 is yet another flow chart of a water level control method of an air conditioner, in accordance with some embodiments.

In some embodiments, as shown in FIG. 9, after the step 73, the step 7 further includes step 74 to step 78 (S74 to S78).

In step 74, the timer is controlled to start timing.

The air conditioner 1000 may include a timer, and the timer times a duration $T_C$ during which the condenser temperature T is less than the third preset temperature $T_3$ and the ambient temperature $T_0$ is less than the second preset ambient temperature $T_{02}$.

It will be noted that, before a condition of the condenser temperature T being less than the third preset temperature $T_3$ and the ambient temperature $T_0$ being less than the second preset ambient temperature $T_{02}$ is not satisfied, an initial value of the duration $T_C$ is zero.

In step 75, the duration $T_C$ of the condenser temperature T changing from being less than the third preset temperature $T_3$ and the ambient temperature $T_0$ being less than the second preset ambient temperature $T_{02}$ to one of the condenser temperature T being greater than or equal to the third preset temperature $T_3$, and the ambient temperature $T_0$ being greater than or equal to the second preset ambient temperature $T_{02}$ is obtained.

In step 76, whether the duration $T_C$ has reached a predetermined time $T_{C0}$ is determined. If not, the step 71 is performed; if so, the step 77 is performed.

In a case where the duration $T_C$ is less than the predetermined time $T_{C0}$, the condenser temperature T may rise to be greater than or equal to the third preset temperature $T_3$, or the ambient temperature $T_0$ may rise to be greater than or equal to the second preset ambient temperature $T_{02}$. In this case, the load of the air conditioner 1000 is high, and the condensed water may not be evaporated by the condenser in a timely manner. Therefore, the controller 30 needs to control the compressor 101 to stop in a timely manner, so as to prevent the condenser temperature T from being too high and prevent the water level of the condensed water from continuing to rise.

In step 77, whether the water level of the condensed water has reached the second preset water level B is determined. If so, the step 78 is performed; if not, the step 2 is performed.

In step 78, the compressor 101 is controlled to stop.

In a case where the duration $T_C$ is less than the predetermined time $T_{C0}$, the condensed water continues to be evaporated by the condenser. In a case where the duration $T_C$ has reached the predetermined time $T_{C0}$, if the water level of the condensed water has reached the second preset water level B, the water level of the condensed water is still high. In order to prevent the water level of the condensed water from continuing to rise, the controller 30 needs to control the compressor 101 to stop in a timely manner, so as to prevent the air conditioner 1000 from continuing to generate the condensed water, thereby preventing the condensed water from overflowing. Moreover, the controller 30 controls the compressor 101 to stop, which may also prevent the condenser temperature T from continuing to rise and avoid damage to the air conditioner 1000.

For example, when the compressor 101 is stopped, the display device 1001 of the air conditioner 1000 may display fault information, so that the user may find out that the water level of the condensed water is too high and take corresponding measures in a timely manner. The fault information may display content such as the air conditioner faults.

In a case where the duration $T_C$ has reached the predetermined time $T_{C0}$, if the water level of the condensed water is lower than the second preset water level B, the water level of the condensed water has dropped. In this case, the controller 30 may determine again whether the water level of the condensed water has reached the first preset water level A (i.e., the step 2).

In some embodiments, the predetermined time $T_{C0}$ is any value within a range of 28 min to 60 min.

In a case where the duration $T_C$ is less than or equal to the predetermined time $T_{C0}$, although the condensed water continues to be evaporated by the condenser, the water level of the condensed water may still rise or drop. In a case where the predetermined time $T_{C0}$ is 30 min, if the water level of the condensed water rises, the condensed water will not overflow due to the predetermined time $T_{C0}$ being too long; moreover, the predetermined time $T_{C0}$ may also meet the demand for condensed water to be evaporated by the condenser. Of course, since the air conditioner 1000 may have various models, the predetermined time $T_{C0}$ may also be 60 min.

In addition, the controller 30 determines whether the water level of the condensed water still at the second preset water level B after the duration $T_C$ reaches the predetermined time $T_{C0}$, which may improve the accuracy of the determination of the controller 30 and avoid affecting the operation of the air conditioner 1000.

In some embodiments, the third preset temperature $T_3$ is any value within a range of 43° C. to 47° C. The second preset ambient temperature $T_{02}$ is any value within a range of 30° C. to 34° C. In this way, the controller 30 may control the condenser temperature T and the ambient temperature $T_0$ timely and accurately through the values of the third preset temperature $T_3$ and the second preset ambient temperature $T_{02}$.

It will be noted that, the third preset temperature $T_3$ may be equal to or not equal to the second preset temperature $T_2$, and the second preset ambient temperature $T_{02}$ may be equal to or not equal to the first preset ambient temperature $T_{01}$, and the present disclosure is not limited thereto.

Hereinafter, the water level control method of the air conditioner in some embodiments of the present disclosure will be illustratively described with reference to FIGS. 10 and 11.

In the case where the air conditioner 1000 operates in one of the cooling mode and the dehumidification mode, the condensed water generated by the air conditioner 1000 flows into the water tank 1002.

Figure 10:
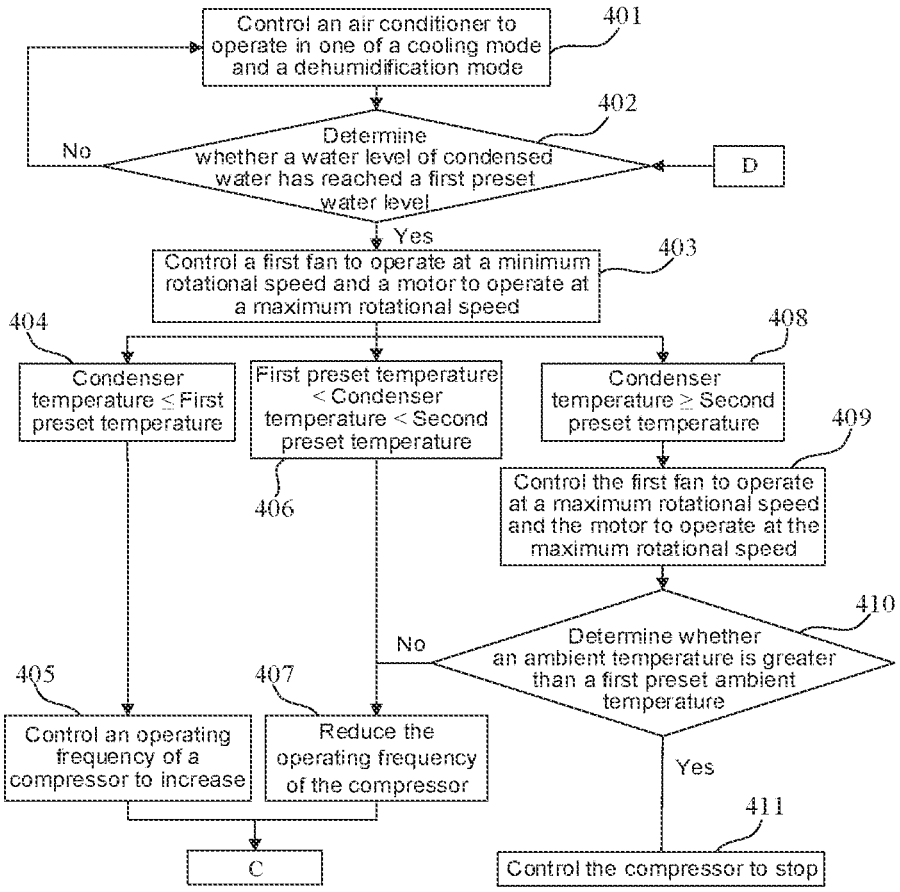
FIG. 10 is yet another flow chart of a water level control method of an air conditioner, in accordance with some embodiments.

As shown in FIG. 10, the water level control method of the air conditioner includes step 401 to step 411 (S401 to S411).

In step 401, the air conditioner 1000 is controlled to operate in one of the cooling mode and the dehumidification mode.

In step 402, whether the water level of the condensed water has reached the first preset water level A is determined. If so, the step 403 is performed; if not, the step 401 is performed. For example, the air conditioner 1000 continues to operate in one of the cooling mode and the dehumidification mode.

In step 403, the first fan 104 is controlled to operate at the minimum rotational speed, and the motor 1004 is controlled to operate at the maximum rotational speed.

In step 404, if it is determined that the condenser temperature T is less than or equal to the first preset temperature $T_1$, the step 405 is performed. Here, the controller 30 may obtain the condenser temperature T detected by the first temperature sensor 1007.

In step 405, the operating frequency of the compressor 101 is controlled to increase.

In step 406, if it is determined that the condenser temperature T is greater than the first preset temperature $T_1$ and less than the second preset temperature $T_2$, the step 407 is performed.

In step 407, the operating frequency of the compressor 101 is reduced.

In step 408, if it is determined that the condenser temperature T is greater than or equal to the second preset temperature $T_2$, the step 409 is performed.

In step 409, the first fan 104 is controlled to operate at the maximum rotational speed, and the motor 1004 is controlled to operate at the maximum rotational speed.

In step 410, whether the ambient temperature $T_0$ is greater than the first preset ambient temperature $T_{01}$ is determined.

If so, the step 411 is performed; if not, the step 407 is performed. Here, the controller 30 may obtain the ambient temperature $T_0$ through the second temperature sensor 1008.

In step 411, the compressor 101 is controlled to stop.

Figure 11:
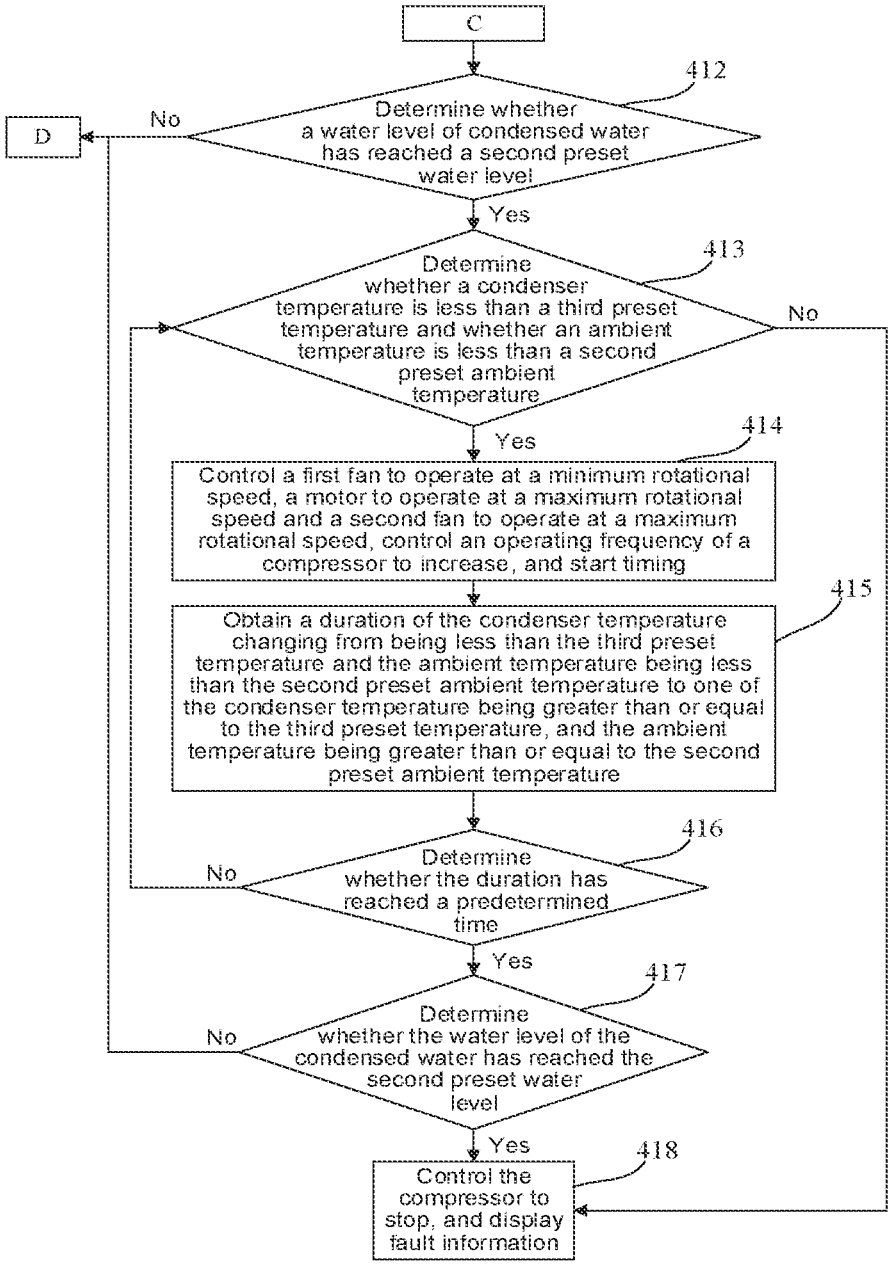
FIG. 11 is yet another flow chart of a water level control method of an air conditioner, in accordance with some embodiments.

As shown in FIG. 11, after the step 405 or the step 407, the water level control method of the air conditioner further includes step 412 to step 418 (S412 to S418).

In step 412, whether the water level of the condensed water has reached the second preset water level B is determined. If so, the step 413 is performed; if not, the step 402 is performed.

In step 413, whether the condenser temperature T is less than the third preset temperature $T_3$ and whether the ambient temperature $T_0$ is less than the second preset ambient temperature $T_{02}$ is determined. If so, the step 414 is performed; if not, the step 418 is performed.

In step 414, the first fan 104 is controlled to operate at the minimum rotational speed, the motor 1004 is controlled to operate at the maximum rotational speed and the second fan 202 is controlled to operate at the maximum rotational speed, the operating frequency of the compressor 101 is controlled to increase, and timing is started to be counted.

In step 415, the duration $T_C$ of the condenser temperature T changing from being less than the third preset temperature $T_3$ and the ambient temperature $T_0$ being less than the second preset ambient temperature $T_{02}$ to one of the condenser temperature T being greater than or equal to the third preset temperature $T_3$, and the ambient temperature $T_0$ being greater than or equal to the second preset ambient temperature $T_{02}$ is obtained.

For example, in a case where the condenser temperature T is less than the third preset temperature $T_3$ and the ambient temperature $T_0$ is less than the second preset ambient temperature $T_{02}$, the timer times the duration $T_C$ during which the condenser temperature T is less than the third preset temperature $T_3$ and the ambient temperature $T_0$ is less the second preset temperature $T_{02}$. The initial value of the duration $T_C$ is zero before the timer starts timing the duration $T_C$.

In step 416, whether the duration $T_C$ has reached the predetermined time $T_{C0}$ is determined. If so, the step 417 is performed; if not, the step 413 is performed.

It will be noted that, in a case where the duration $T_C$ is less than the predetermined time $T_{C0}$, if one of the condenser temperature T being greater than or equal to the third preset temperature $T_3$, and the ambient temperature $T_0$ being greater than or equal to the second preset ambient temperature $T_{02}$ is satisfied, the controller 30 controls the compressor 101 to stop.

In step 417, whether the water level of the condensed water has reached the second preset water level B is determined. If so, the step 418 is performed; if not, the step 402 is performed.

In step 418, the compressor 101 is controlled to stop, and fault information is displayed.

The water level control method of the air conditioner provided in some embodiments of the present disclosure has an advantage of precise water level control.

Some embodiments of the present disclosure further provide an air conditioner. A structure of the air conditioner is similar to that of the air conditioner 1000, and the air conditioner includes a compressor, a condenser, a first fan, a water tank, a rotating wheel, a motor, and a controller. The controller is configured to perform the water level control method of the air conditioner.

In some embodiments, the controller is configured to: control the air conditioner to operate in one of a cooling mode and a dehumidification mode; in a case where a water level of condensed water has reached a first preset water level, control the first fan to operate at the minimum rotational speed and the motor to operate at the maximum rotational speed, and obtain a condenser temperature, control at least one of a rotational speed of the first fan, a rotational speed of the motor or an operating frequency of the compressor according to the condenser temperature; in a case where the water level of the condensed water has reached a second preset water level, obtain the condenser temperature and an ambient temperature, and control the compressor according to the condenser temperature and the ambient temperature. Here, the second preset water level is higher than the first preset water level.

Figure 12:
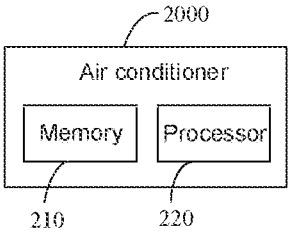
FIG. 12 is a block diagram of yet another air conditioner, in accordance with some embodiments.

As shown in FIG. 12, some embodiments of the present disclosure further provide an air conditioner 2000 including a memory 210 and a processor 220. The memory 210 stores one or more computer programs, which include instructions. When the instructions are executed by the processor 220, the air conditioner 2000 is caused to perform the water level control method of the air conditioner.

A person skilled in the art will understand that the scope of disclosure in the present disclosure is not limited to specific embodiments discussed above, and may modify and substitute some elements of the embodiments without departing from the spirits of this application. The scope of this application is limited by the appended claims.

What is claimed is:

1. A water level control method of an air conditioner, wherein the air conditioner includes a first fan, a condenser, a compressor, a water tank, a rotating wheel, and a motor, and the first fan is configured to dissipate heat from the condenser and the compressor, the motor is configured to drive the rotating wheel to rotate, so as to spray condensed water in the water tank onto the condenser, and the water level control method comprises:

when a water level of the condensed water reaches a first preset water level, controlling the first fan to operate at a minimum rotational speed and the motor to operate at a maximum rotational speed, and obtaining a condenser temperature, and controlling at least one of a rotational speed of the first fan, a rotational speed of the motor, or an operating frequency of the compressor according to the condenser temperature;

wherein the controlling at least one of the rotational speed of the first fan, the rotational speed of the motor, or the operating frequency of the compressor according to the condenser temperature, includes:

when the condenser temperature is less than or equal to a first preset temperature, increasing the operating frequency of the compressor;

when the condenser temperature is greater than the first preset temperature and less than a second preset temperature, reducing the operating frequency of the compressor; and when the condenser temperature is greater than or equal to the second preset temperature, controlling the first fan to operate at a maximum rotational speed and the motor to operate at the maximum rotational speed, obtaining an ambient temperature, and controlling the operating frequency of the compressor according to the ambient temperature.

2. The water level control method of the air conditioner according to claim 1, wherein when the condenser temperature is greater than or equal to the second preset temperature, the controlling the first fan to operate at a maximum rotational speed and the motor to operate at the maximum rotational speed, the obtaining an ambient temperature, and the controlling the operating frequency of the compressor according to the ambient temperature, includes:

when the ambient temperature is greater than a first preset ambient temperature, controlling the compressor to stop; and when the ambient temperature is less than or equal to the first preset ambient temperature, reducing the operating frequency of the compressor.

3. The water level control method of the air conditioner according to claim 2, wherein the first preset temperature is any value within a range of 36° C. to 40° C., and the second preset temperature is any value within a range of 43° C. to 47° C., and the first preset ambient temperature is any value within a range of 30° C. to 34° C.

4. The water level control method of the air conditioner according to claim 1, wherein before obtaining the condenser temperature, the method further comprises:

controlling the air conditioner to operate for a preset duration in advance.

5. The water level control method of the air conditioner according to claim 1, wherein the controlled rotational speed of the first fan is any value within a range of 650 r/min to 1000 r/min.

6. The water level control method of the air conditioner according to claim 1, further comprising:

when the water level of the condensed water reaches a second preset water level, obtaining the condenser temperature and an ambient temperature, and controlling the compressor according to the condenser temperature and the ambient temperature;

wherein the second preset water level is higher than the first preset water level.

7. The water level control method of the air conditioner according to claim 6, wherein the controlling the compressor according to the condenser temperature and the ambient temperature, includes:

when one of the condenser temperature being greater than or equal to a third preset temperature, and the ambient temperature being greater than or equal to a second preset ambient temperature is satisfied, controlling the compressor to stop.

8. The water level control method of the air conditioner according to claim 7, wherein the third preset temperature is any value within a range of 43° C. to 47° C., and the second preset ambient temperature is any value within a range of 30° C. to 34° C.

9. The water level control method of the air conditioner according to claim 8, wherein the third preset temperature is equal to the second preset temperature, and the second preset ambient temperature is equal to a first preset ambient temperature.

10. The water level control method of the air conditioner according to claim 6, wherein the air conditioner further includes a second fan, and the second fan is configured to drive circulation and exchange of air inside the air conditioner and air outside the air conditioner, and the controlling the compressor according to the condenser temperature and the ambient temperature, further includes:

when the condenser temperature is less than the third preset temperature and the ambient temperature is less than the second preset ambient temperature, controlling the first fan to operate at the minimum rotational speed and the second fan to operate at a maximum rotational speed, increasing the operating frequency of the compressor, and starting timing;

obtaining a duration of the condenser temperature changing from being less than the third preset temperature and the ambient temperature being less than the second preset ambient temperature to one of the condenser temperature being greater than or equal to the third preset temperature, and the ambient temperature being greater than or equal to the second preset ambient temperature;

when the duration is less than a predetermined time, returning to determine whether the condenser temperature is less than the third preset temperature and whether the ambient temperature is less than the second preset ambient temperature; and when the duration is greater than or equal to the predetermined time, controlling the compressor according to the water level of the condensed water.

11. The water level control method of the air conditioner according to claim 10, wherein when the duration is greater than or equal to the predetermined time, controlling the compressor according to the water level of the condensed water, includes:

when the water level of the condensed water reaches the second preset water level, controlling the compressor to stop; and when the water level of the condensed water is lower than the second preset water level, returning to determine whether the water level of the condensed water reaches the first preset water level.

12. The water level control method of the air conditioner according to claim 10, wherein the predetermined time is any value within a range of 28 min to 60 min.

13. The water level control method of the air conditioner according to claim 10, wherein a controlled rotational speed of the second fan is any value within a range of 750 r/min to 1200 r/min.

14. The water level control method of the air conditioner according to claim 6, wherein the water tank includes a water tank body and a groove connected with the water tank body, and the groove is configured to accommodate the condensed water overflowing from the water tank body; the first preset water level is two-thirds of a maximum capacity of the water tank body; and the second preset water level is the maximum capacity of the water tank body.

15. The water level control method of the air conditioner according to claim 14, wherein a capacity of the groove is one-third of the maximum capacity of the water tank body.

16. The water level control method of the air conditioner according to claim 6, wherein the air conditioner includes a first water level switch and a second water level switch, the first water level switch is configured to detect the first preset water level of the condensed water in the water tank, and the second water level switch is configured to detect the second preset water level of the condensed water in the water tank.

17. The water level control method of the air conditioner according to claim 6, wherein the air conditioner includes a first temperature sensor and a second temperature sensor, the first temperature sensor is configured to detect the condenser temperature, and the second temperature sensor is configured to detect the ambient temperature.

18. An air conditioner, comprising:

a condenser;

a compressor;

a first fan configured to dissipate heat from the condenser and the compressor;

a water tank configured to accommodate condensed water generated during operation of the air conditioner;

a rotating wheel;

a motor connected to the rotating wheel, and the motor being configured to drive the rotating wheel to rotate, so as to spray the condensed water in the water tank onto the condenser; and a controller configured to:

when a water level of the condensed water reaches a first preset water level, control the first fan to operate at a minimum rotational speed and the motor to operate at a maximum rotational speed, and obtain a condenser temperature, and control at least one of a rotational speed of the first fan, a rotational speed of the motor, or an operating frequency of the compressor according to the condenser temperature; and when the water level of the condensed water reaches a second preset water level, obtain the condenser temperature and an ambient temperature, and control the compressor according to the condenser temperature and the ambient temperature;

wherein the second preset water level is higher than the first preset water level;

wherein the controlling at least one of the rotational speed of the first fan, the rotational speed of the motor, or the operating frequency of the compressor according to the condenser temperature, includes:

when the condenser temperature is less than or equal to a first preset temperature, increasing the operating frequency of the compressor;

when the condenser temperature is greater than the first preset temperature and less than a second preset temperature, reducing the operating frequency of the compressor; and when the condenser temperature is greater than or equal to the second preset temperature, controlling the first fan to operate at a maximum rotational speed and the motor to operate at the maximum rotational speed, obtaining an ambient temperature, and controlling the operating frequency of the compressor according to the ambient temperature.

19. An air conditioner, comprising:

a memory; and a processor;

wherein the memory stores one or more computer programs, and the one or more computer programs include instructions, and when the instructions are executed by the processor, cause the air conditioner to execute the water level control method of the air conditioner according to claim 15.

* * * * *